US006416364B1

(12) United States Patent
Shi et al.

(10) Patent No.: US 6,416,364 B1
(45) Date of Patent: Jul. 9, 2002

(54) RJ-45 RECEPTACLE CONNECTOR WITH TERMINAL PROTECTION MEANS

(75) Inventors: GuangXing Shi; Qiang Chen; Suiya Wang, all of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/997,337

(22) Filed: Nov. 29, 2001

(51) Int. Cl.[7] ..... H01R 13/64
(52) U.S. Cl. ..... 439/680; 439/676
(58) Field of Search ..... 439/677, 680, 439/676, 490, 681

(56) References Cited

U.S. PATENT DOCUMENTS 4,341,428 A * 7/1982 Hatch et al. ..... 439/681
4,773,881 A * 9/1988 Adams, III ..... 439/481
4,878,858 A * 11/1989 Dechelette ..... 439/680
5,769,668 A * 6/1998 Tondreault ..... 439/680
6,146,210 A * 11/2000 Cha et al. ..... 439/680
6,186,835 B1 * 2/2001 Cheshire ..... 439/677
6,257,935 B1 * 7/2001 Zhang et al. ..... 439/676
6,312,293 B1 * 11/2001 Wang ..... 439/677
6,319,070 B1 * 11/2001 Tan ..... 439/676

* cited by examiner

*Primary Examiner*—Gary F. Paumen
*Assistant Examiner*—James R. Harvey
(74) *Attorney, Agent, or Firm*—Wei Te Chung

(57) ABSTRACT

A receptacle connector (2) comprises an insulative housing (20) defining a receiving space (200) and a terminal module (21) received in the receiving space. The terminal module comprises a dielectric base (210) and a plurality of terminals (220) retained in the dielectric base. The dielectric base has a plurality of upwardly extending ribs (215) each having an inclined supporting face (217). Each terminal comprising a slant contacting portion (225) in alignment with a corresponding rib. When mating with a plug connector, the contacting portions are deflected downwardly and supported by the supporting faces of the ribs.

1 Claim, 6 Drawing Sheets

RJ-45 RECEPTACLE CONNECTOR WITH TERMINAL PROTECTION MEANS

BACKGROUND OF THE INVENTION

1. Field of the Invention

The present invention relates to a receptacle connector, and particularly to an RJ-45 receptacle connector that can prevent terminal thereof from being damaged even when mismating with an RJ-11 plug connector.

2. Description of Related Art

A modular jack assembly, known as an RJ-45 connector assembly or an RJ-11 connector assembly, comprises a plug connector and a mating receptacle connector. An RJ-45 connector assembly used for a network communication has dimensions larger than those of an RJ-11 connector assembly which is used for a telephone. Therefore, an RJ-11 plug connector may be mistakenly inserted into an RJ-45 receptacle connector, which may result in damage to the terminals of the RJ-45 receptacle connector.

Hence, an improved RJ-45 receptacle connector is required to deal with mismating with a non-complementary RJ-11 plug connector. U.S. Pat. Nos. 6,257,935, 6,319,070 and 6,312,293 all having the same assignee with the invention, disclose some approaches to achieve this object. Anyhow, all of them require to use additional separate parts attached to the housing, thus taking labor and time. The invention discloses a simple and easy-to-make connector in comparison with the arts.

SUMMARY OF THE INVENTION

Accordingly, one object of the present invention is to provide an RJ-45 receptacle connector that can prevent terminal thereof from being damaged even when mismating with an RJ-11 plug connector.

Another object of the present invention is to provide an RJ-45 receptacle connector that can prevent terminals from being deflected unduly.

In order to achieve the objects set forth, an RJ-45 receptacle connector in accordance with the present invention comprises a housing defining a receiving space for receiving a complementary RJ-45 plug connector and a terminal module assembled in the receiving space. The terminal module comprises a dielectric base and a plurality of terminals assembled on the dielectric base. The dielectric base comprises a plurality of upwardly extending front-to-back ribs. Every two adjacent ribs define a receiving groove and each rib forms an inclined supporting face. Each of the terminals comprises a spring contacting portion in alignment with a corresponding rib. The complementary plug connector comprises a plurality of separating walls and a plurality of contacts assembled between the separating walls for connecting with the terminals. When mating, front ends of the separating walls of the complementary plug connector are received in corresponding receiving grooves of the RJ-45 receptacle connector. The spring contacting portion is deflected downwardly by a corresponding contact and supported by the inclined supporting face. When a noncomplementary plug connector is inserted into the receptacle connector, the ribs would prevent the plug connector from further insertion because the number of its separating walls is not equal to that of the receiving grooves and.

Other objects, advantages and novel features of the invention will become more apparent from the following detailed description when taken in conjunction with the accompanying drawings.

DETAILED DESCRIPTION OF THE INVENTION

Figure 1:
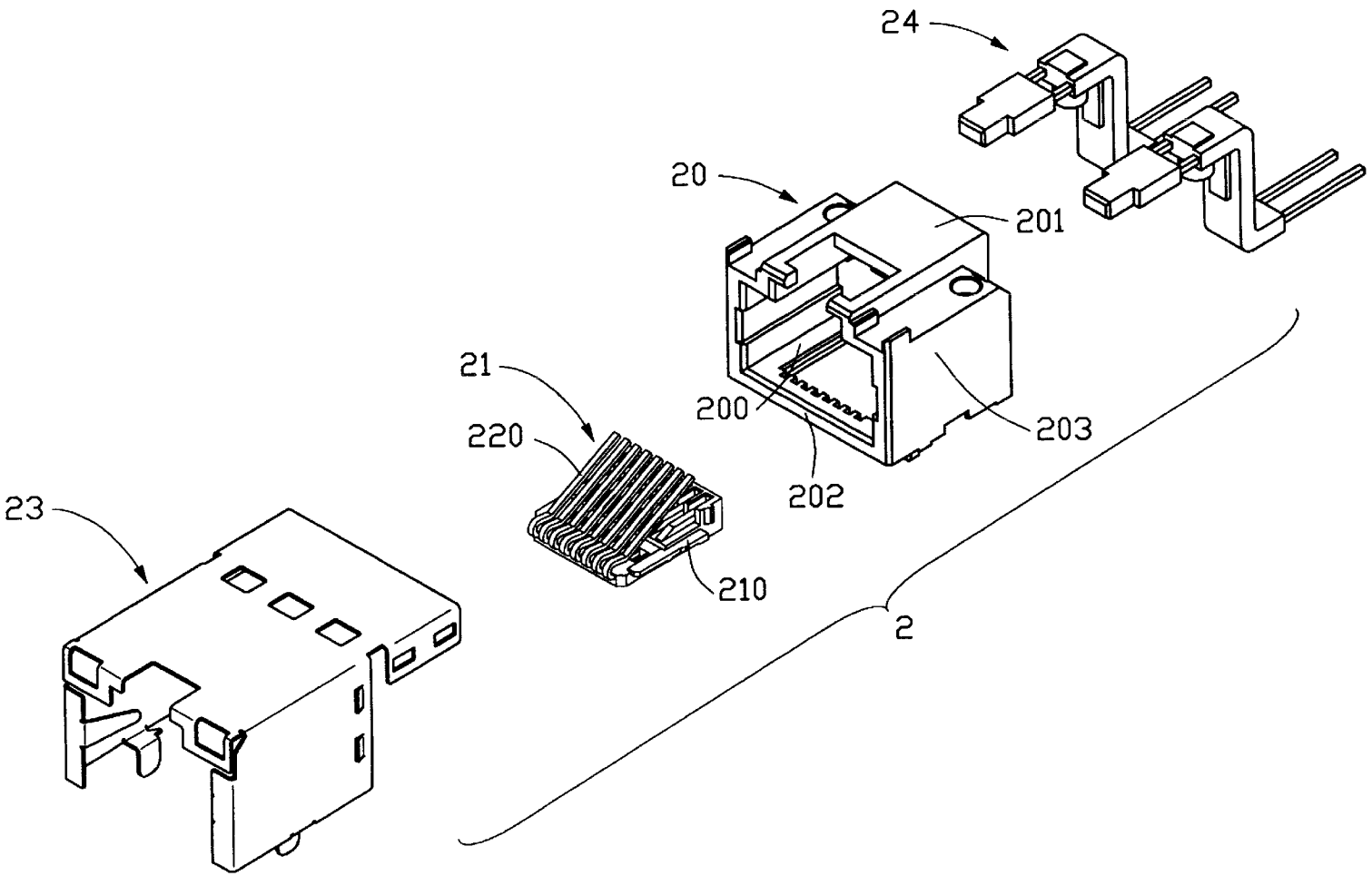
FIG. 1 is a perspective, exploded view of an RJ-45 receptacle connector of the present invention.

Reference will now be made to the drawing figures to describe the present invention in detail.

Referring to FIG. 1, an RJ-45 receptacle connector 2 in accordance with the present invention comprises a first insulative housing 20, a terminal module 21 assembled in the first insulative housing 20, a pair of LEDs (light emitting diodes) 24 assembled on the first insulative housing 20, and a grounding shield 23 enclosing the first insulative housing 20.

The first insulative housing 20 comprises a top wall 201, an opposite bottom wall 202 and a pair of side walls 203. The top wall 201, the bottom wall 202 and the side walls 203 together define a receiving space 200 therebetween for receiving the terminal module 21 and an RJ-45 plug connector 3 (shown in FIG. 4A).

Figure 2:
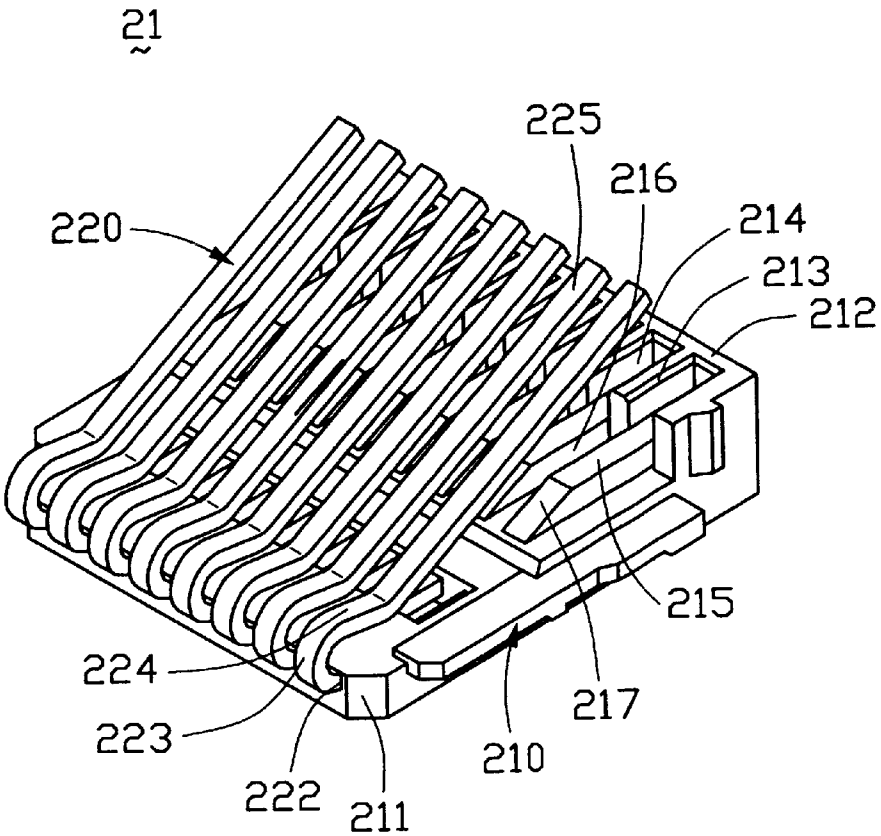
FIG. 2 is an enlarged, perspective view of a terminal module of the RJ-45 receptacle connector in FIG. 1.

Referring to FIG. 2, the terminal module 21 comprises a dielectric base 210 and a plurality of terminals 220 insert molded with the dielectric base 210. The dielectric base 210 comprises a horizontal bottom wall 211, a rear wall 212 extending upwardly from a rear end of the bottom wall 211, and a plurality of block walls 213 extending forwardly from the rear wall 212. Every two block walls 213 define a guiding groove 214. The dielectric base 210 further comprises a plurality of ribs 215 extending upwardly from the bottom wall 211 between and out of the guiding grooves 214. Every two ribs 215 define a receiving groove 216 and each rib 215 forms an inclined supporting face 217 at a certain angle with the bottom wall 211. Also referring to FIG. 5, each of the terminals 220 comprises a mounting portion 222 insert molded with the bottom wall 211 of the dielectric base 210, a tail portion 221 projecting rearwardly from a rear end of the mounting portion 222 beyond the rear wall 212 for soldering on a mating printed circuit board (PCB) (not shown), a bent portion 223 extending upwardly from a front end of the mounting portion 222, a horizontal portion 224 extending rearwardly from a top end of the bent portion 223, and a spring contacting portion 225 extending slantly from a rear end of the horizontal portion 224 in alignment with a corresponding rib 215.

Figure 3:
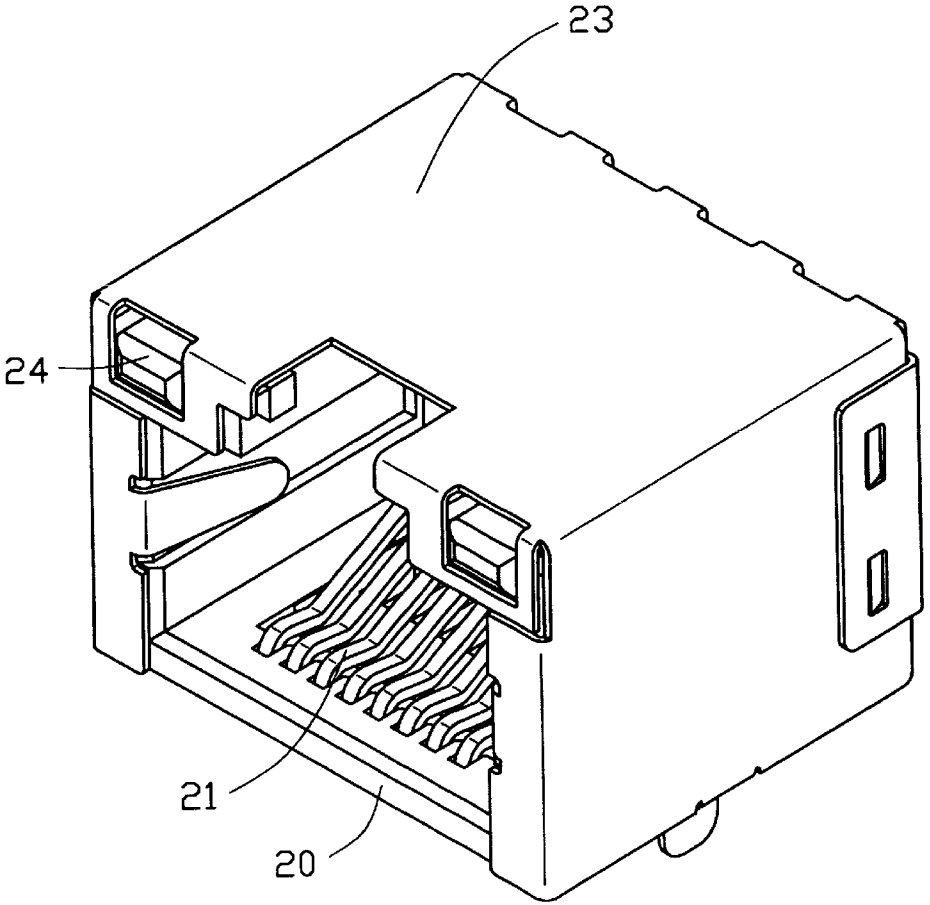
FIG. 3 is a perspective, assembled view of the RJ-45 receptacle connector in FIG. 1.

Referring to FIG. 3, in assembly, the terminal module 21 is assembled in the receiving space 200 from a rear end of the first insulative housing 20. The LEDs 24 are assembled on a top side of the first insulative housing 20. Finally, the grounding shield 23 encloses the first insulative housing 20 with a rear portion bent downwardly.

Figure 4B:
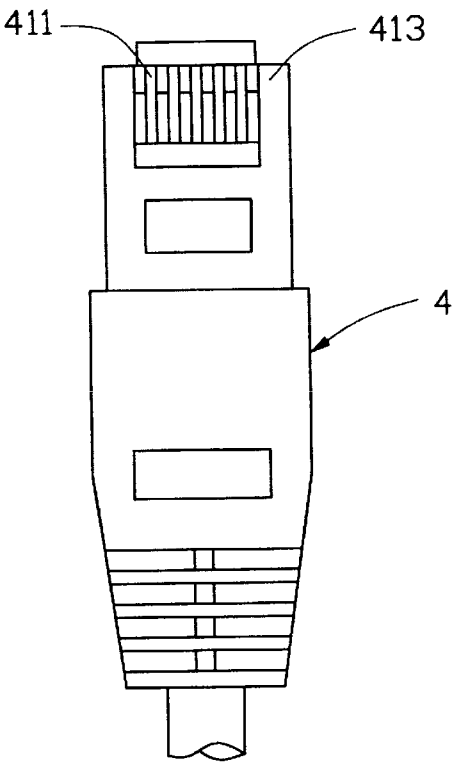
FIG. 4B is a bottom, planar view of an RJ-45 plug connector.
Figure 4A:
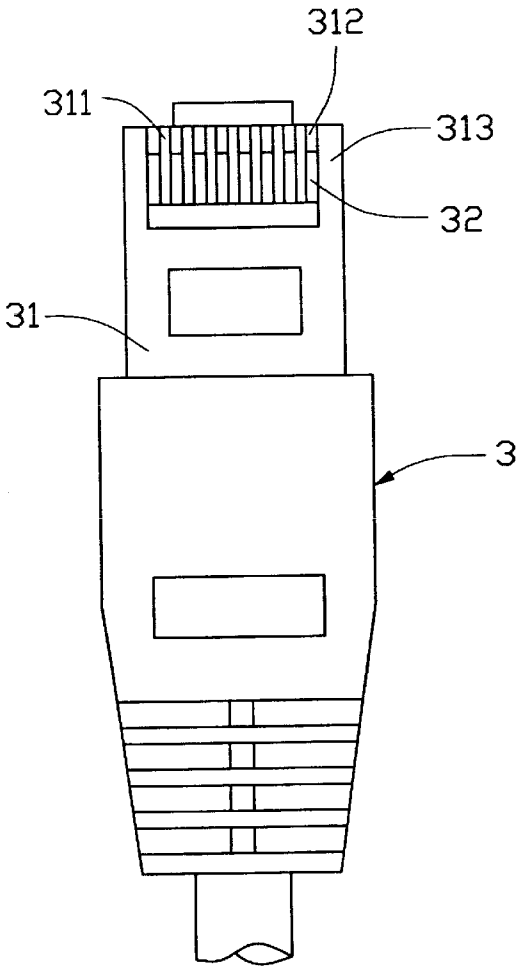
FIG. 4A is a bottom, planar view of an RJ-45 plug connector.

Referring to 4A, the RJ-45 plug connector 3 comprises a second insulative housing 31 and a plurality of contacts 32 assembled in the second insulative housing 31. The second insulative housing 31 comprises a pair of sidewalls 313 at transverse sides thereof and a plurality of bottom separating walls 311 between the sidewalls 313 at a front end thereof. A plurality of receiving channels 312 are defined between adjacent separating walls 311 and sidewalls 313 for receiving the contacts 32. Referring to FIG. 4B, an RJ-11 plug connector 4 comprises a pair of sidewalls 413 and a plurality of separating walls 411 between the sidewalls 413. It should be noted that the number of the separating walls 411 of the RJ-11 plug connector 4 is less than that of the separating walls 311 of the RJ-45 plug connector 3. In other words, the RJ-45 plug connector 3 and the RJ-11 plug connector 4 have the same height(thickness) with each other while the RJ-11 plug connector 4 has a smaller lateral dimension than the RJ-45 plug connector 3.

Figure 5:
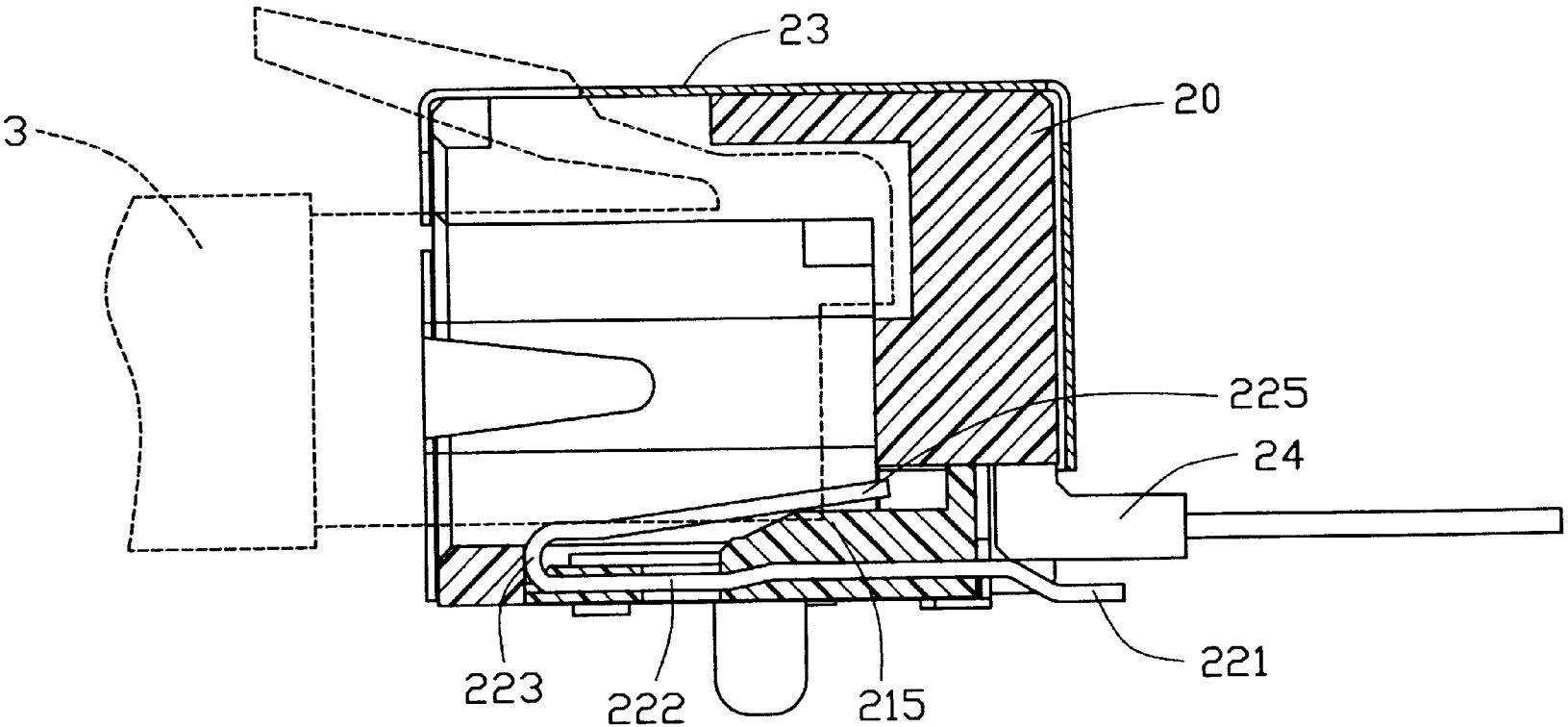
FIG. 5 is a cross-sectional view illustrating the engagement between the RJ-45 receptacle connector and the RJ-45 plug connector.
Figure 6:
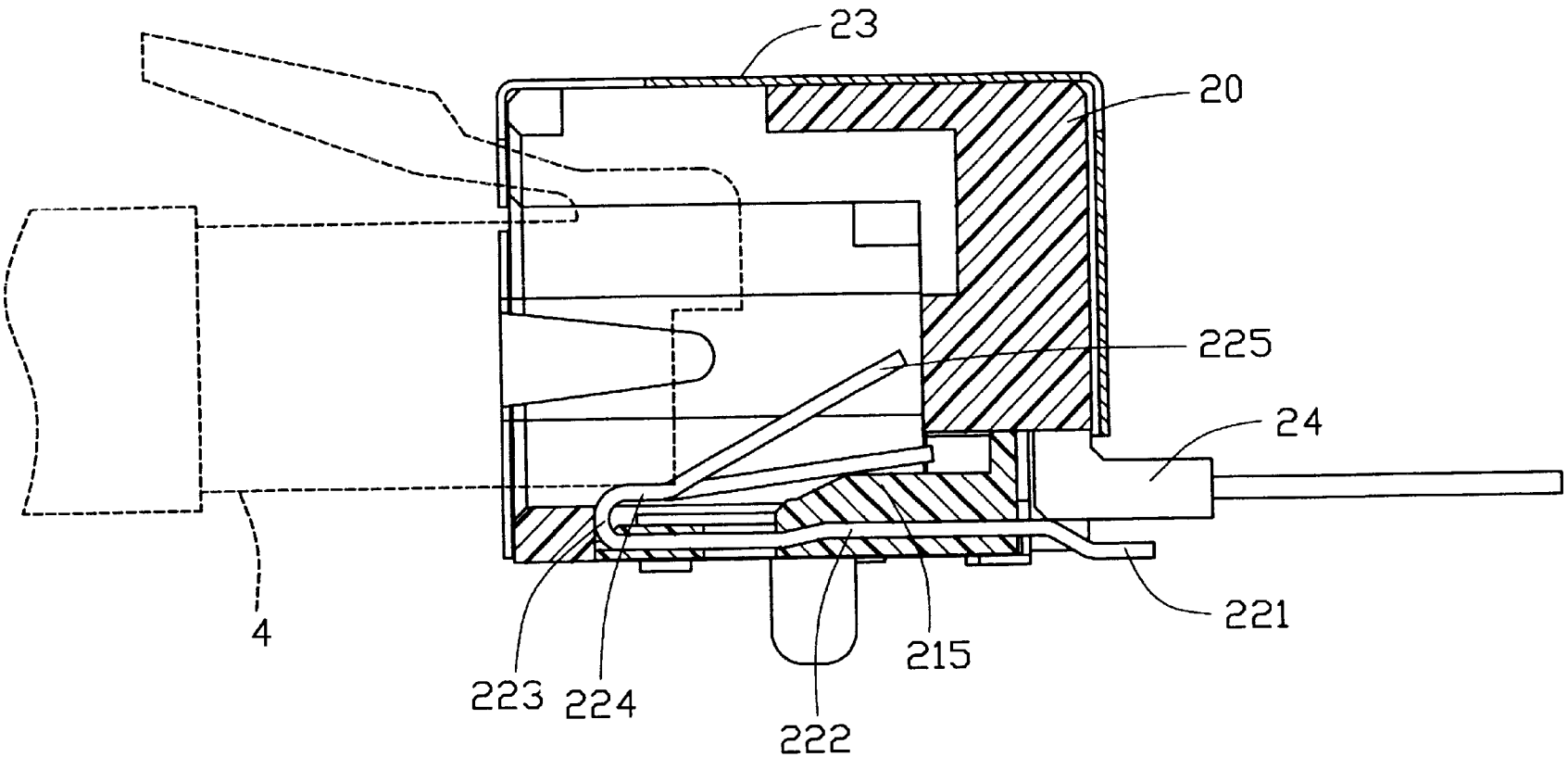
FIG. 6 is a cross-sectional view illustrating the engagement between the RJ-45 receptacle connector and the RJ-11 plug connector.

Referring to FIG. 5, in mating, the RJ-45 plug connector 3 is plugged into the receiving space 200 with front ends of the separating walls 311 being aligned with the corresponding receiving grooves 216 of the RJ-45 receptacle connector 2. The contacting portions 225 of the terminals 22 of the RJ-45 receptacle connector 2 connect with corresponding contacts 32 of the RJ-45 plug connector 3, thereby achieving an electrical connection between the RJ-45 receptacle connector 2 and the RJ-45 plug connector 3. Under this situation, the outer terminal 220 experiences less deflection and the rib 215 thereunder will not hinder its deflection. It is because the corresponding outer contact 32 of the RJ-45 plug connector 3 which engages the outer terminal 220, is hidden in the channel 312 and structurally offset behind and lower than the corresponding separating wall 311 or side wall 313. In opposite, referring to FIG. 6, if the RJ-11 plug connector 4 is inserted into the RJ-45 receptacle connector 2, the RJ-11 plug connector 4 cannot be fully inserted into the receiving space 200 of the RJ-45 receptacle connector 2 because the number of the separating walls 411 is less than that of the receiving grooves 216. During insertion, the side walls 413 of the RJ-11 plug connector 4 press outer terminals 220 downwardly, with more deflection in comparison with that in FIG. 5, to abut against the supporting faces 217 of the ribs 215 of the terminal module 21. Thus, further insertion of the RJ-11 plug connector 4 into the RJ-45 receptacle connector 2 is efficiently prevented by the ribs 215. In addition, even if a plug connector, which may be of any other noncomplementary type to the RJ-45 receptacle connector 2, were unduly inserted into the receiving space 200 of the RJ-45 receptacle connector 2, all the contacting portions 225 of the terminals 22 would be resiliently supported by the ribs 215 to prevent over deflection and damage to the terminals 22.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A modular jack assembly comprising:

a receptacle connector comprising an insulative housing defining a receiving space and a terminal module assembled in the receiving space, the terminal module comprising a dielectric base and a plurality of terminals retained in the dielectric base, the dielectric base comprising a plurality of front-to-back ribs extending upwardly from a bottom wall thereof and a plurality of receiving grooves defined between the ribs; and a plug connector inserted into the receiving space, the plug connector comprising a plurality of separating walls received in corresponding receiving grooves of the receptacle connector, and a plurality of contacts connecting with the terminals;

wherein each terminal comprises a mounting portion retained in the dielectric base, a tail portion extending rearwardly from the mounting portion and rearwardly out of the dielectric base, a bent portion extending upwardly from a front end of the mounting portion, a horizontal portion extending rearwardly from a top end of the bent portion, and a spring contacting portion extending at a slant from a rear end of the horizontal portion for connecting with a corresponding contact of the plug connector;

wherein each of the ribs has an inclined supporting face to support the contacting portion of a corresponding terminal during mating of the connectors;

wherein the width of the receiving groove of the receptacle connector is larger than the width of the separating, wall for the plug connector.

* * * * *